US011133636B2

(12) United States Patent
Bossuyt et al.

(10) Patent No.: US 11,133,636 B2
(45) Date of Patent: Sep. 28, 2021

(54) METHOD FOR MANUFACTURING A MALE POWER TERMINAL, AND MALE POWER TERMINAL

(71) Applicant: Aptiv Technologies Limited, St. Michael (BB)

(72) Inventors: Sylvain Bossuyt, Boutigny-Prouais (FR); François Cormier, Dammarie-sur-Loing (FR)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 16/841,453

(22) Filed: Apr. 6, 2020

(65) Prior Publication Data

US 2020/0328569 A1 Oct. 15, 2020

(30) Foreign Application Priority Data

Apr. 12, 2019 (FR) ..... 1903957

(51) Int. Cl.

| | |
|---|---|
| ***H01R 43/16*** | (2006.01) |
| ***H01R 4/58*** | (2006.01) |
| ***H01R 4/70*** | (2006.01) |
| ***H01R 43/00*** | (2006.01) |

(52) U.S. Cl.

CPC ..... *H01R 43/16* (2013.01); *H01R 4/58* (2013.01); *H01R 4/70* (2013.01); *H01R 43/005* (2013.01)

(58) Field of Classification Search

CPC . H01R 43/16; H01R 4/58; H01R 4/70; H01R 43/005

USPC ..... 439/884, 281, 693, 948

See application file for complete search history.

(56) References Cited

U.S. PATENT DOCUMENTS

| | | | | |
|---|---|---|---|---|
| 1,331,928 A | | 2/1920 | Katzung | |
| 5,046,964 A | * | 9/1991 | Welsh | H01R 13/52 439/271 |
| 6,113,436 A | * | 9/2000 | Kuwahara | H01R 13/44 439/693 |
| 6,146,166 A | | 11/2000 | Muzslay | |

(Continued)

FOREIGN PATENT DOCUMENTS

| | | |
|---|---|---|
| CN | 103779716 | 5/2014 |
| EP | 2034566 | 3/2009 |
| EP | 2273618 | 1/2011 |

OTHER PUBLICATIONS

"Extended European Search Report", EP Application No. 20167924.8, dated Sep. 2, 2020, 10 pages.

(Continued)

*Primary Examiner* — Peter G Leigh

(74) *Attorney, Agent, or Firm* — Colby Nipper PLLC

(57) ABSTRACT

A male power terminal and method for manufacturing a male power terminal are described. This terminal comprises a contact portion and a connection portion intended to electrically connect the terminal to an electrical circuit. This method comprises an operation of cutting a metal sheet, to form the contact portion and the connection portion. This method also comprises an operation of forming of bending the metal sheet so as to form the contact portion with a tubular shaped and a connection portion with two thicknesses of metal sheet. The method also comprises inserting a portion of a protection cap into the contact portion.

11 Claims, 4 Drawing Sheets

(56) References Cited

U.S. PATENT DOCUMENTS

| | | | | |
|---|---|---|---|---|
| 6,146,211 | A * | 11/2000 | Okamoto | H01R 13/04 439/181 |
| 7,048,562 | B2 * | 5/2006 | Lutsch | H01R 4/20 439/275 |
| 8,398,442 | B2 * | 3/2013 | Yagi | H01R 13/04 439/693 |
| 9,054,437 | B2 * | 6/2015 | Kojima | H01R 13/04 |
| 9,196,971 | B2 * | 11/2015 | Gery | H01R 4/203 |
| 9,431,739 | B2 * | 8/2016 | Fukushima | H01R 13/04 |
| 9,444,167 | B2 | 9/2016 | Fukushima et al. | |
| 9,466,912 | B2 * | 10/2016 | Matsumoto | H01R 13/44 |
| 9,490,567 | B2 * | 11/2016 | Hirakawa | H01R 13/04 |
| 9,531,100 | B2 | 12/2016 | Fukushima et al. | |
| 10,003,152 | B1 | 6/2018 | Bianca et al. | |
| 2005/0287434 | A1 | 12/2005 | Kim et al. | |
| 2009/0075525 | A1 * | 3/2009 | Gaidosch | H01R 13/5812 439/701 |
| 2014/0329396 | A1 * | 11/2014 | Okayasu | H01R 13/04 439/135 |
| 2018/0138630 | A1 | 5/2018 | Nishida et al. | |
| 2019/0310166 | A1 * | 10/2019 | Nodo | G01M 15/104 |

OTHER PUBLICATIONS

"Foreign Office Action", CN Application No. 202010278683.2, dated May 26, 2021, 19 pages.

* cited by examiner

METHOD FOR MANUFACTURING A MALE POWER TERMINAL, AND MALE POWER TERMINAL

RELATED APPLICATIONS

This application claims priority to a French patent application number 1903957, filed in France on Apr. 12, 2019, the entire content of which is incorporated by reference herein.

TECHNICAL FIELD

The disclosure relates to the field of automotive connectors and more particularly to the field of power connectors for automotive vehicles. The disclosure relates in particular to a method for manufacturing a male power terminal, a male power terminal, and a power connector in which at least one such male power terminal is accommodated.

BACKGROUND

In the field of automotive vehicles, including electric vehicles, hybrid vehicles and plug-in hybrid vehicles, high-intensity currents can be transmitted through cables, cable harnesses and/or electrical power circuits, such as those interconnecting a battery, an electric motor, a converter, etc. When it is necessary to integrate connectors into cable networks intended to transmit such high-intensity currents, connectors must be equipped with terminals having sufficient size and section to transmit these high-intensity currents without excessive heating. To this end, the terminals of current power connectors are generally machined by turning processes applied on solid copper bars. This type of machining corresponds to a relatively long and expensive process insofar as it is necessary to sometimes remove a large quantity of material in certain regions of the terminal, while the bar before machining must have over its entire length a section at least equal to that of the region of the finished terminal on which the section is the most important. Further, it is required to provide such male power terminals with an IP2X protection at their free end located near the mating face of the connector within which they are accommodated. For the prior art male terminals, such a protection is formed by a cap made of dielectric material which is clipped over a stud terminating the free end of these terminals. Even further, it is required to provide a sealing barrier between such male power terminals and the connector housing in which they are accommodated.

SUMMARY

In this context it is disclosed a method for manufacturing a male power terminal. This terminal extends longitudinally in a back-to-front direction, from a connection portion to a contact portion. The method includes:—a stamping step for cutting out a single-piece in the thickness of a sheet of metallic material, said single-piece having a first region corresponding to the contact portion and a second region corresponding to the connecting portion, the first and the second regions being in continuity of material with each other, and —a forming step for bending the first region and forming a tubular region having a tubular region length. This method further includes providing a protection cap made of dielectric material and having a first portion and a second portion, and inserting the first portion of the protection cap inside the tubular region.

Thanks to these provisions, methods for manufacturing a male power terminal are improved. Indeed, manufacturing such a terminal from a sheet of metal stamped and rolled up is less time consuming and less expensive. The terminal manufactured this way is hollow but this does not pose a problem in terms of sealing, because inserting a portion of a protection cap into the tubular region provides, on top of its IP2X protection, sealing means preventing, or at least, limiting the water ingress in the tubular region and consequently preventing too much water from entering the connector.

The method for manufacturing a male power terminal may also optionally include at least one of the following features that shall be considered independently of one another or in combination of one or more others:—the method comprises providing a sealing element having a generally cylindrical shape having a longitudinal dimension shorter than the first region length, and inserting the sealing element inside the tubular region, rear of the first portion of the protection cap, relatively to the back-to-front direction;—the sealing element is made of an elastomeric material and the protection cap is made of a plastic material harder than said elastomeric material; —the method comprises cutting out a stop portion during the stamping step, this stop portion being integrally formed with the single-piece, and comprising bending the stop portion at the rear side of the tubular region for preventing the sealing element from getting out of the tubular region when pushed back by the protection cap inserted in the tubular region;—the method comprises forming an annular groove on an outer surface of the tubular region, this annular groove corresponding to an annular rib on an inner surface of the tubular region, and placing an O-ring seal in the groove and the sealing element in sealing contact with the rib; —the method comprises bending two zones of the second region toward each other, to form a connection section with essentially at least two thicknesses of the sheet of metallic material facing one another;—the method comprises at least one shaping operation resulting in the contact portion being shaped with at least two cross sections of different values.

It is also disclosed a male power terminal extending longitudinally in a back-to-front direction, from a connection portion to a contact portion, the contact portion and the connection portion being formed from a single-piece of a sheet of metallic material, the contact portion having a cylindrical tubular region, the cylindrical tubular region having a tubular region length, formed by the sheet of metallic material rolled up around a central axis. This male power terminal comprises a protection cap made of dielectric material and having a first portion and a second portion, the first portion of the protection cap being inserted inside the tubular region.

The male power terminal may also optionally include at least one of the following features that shall be considered independently of one another or in combination of one or more others: it comprises a sealing element having a generally cylindrical shape with a longitudinal dimension shorter than the first region length, this sealing element being inserted inside the tubular region, rear of the first portion of the protection cap, relatively to the back-to-front direction; the sealing element is made of an elastomeric material and the protection cap is made of a plastic material harder than said elastomeric material; it comprises a stop portion integrally formed with the single-piece metallic material, the stop portion being bent at the rear side of the tubular region so as to prevent the sealing element from getting out of the tubular region at a rear side of the tubular region; it comprises an annular groove on an outer surface of the tubular region, this annular groove corresponding to an annular rib on an inner surface of the tubular region, an O-ring seal being placed in the groove and the sealing element being in sealing contact with the rib; it comprises two zones of the second region brought toward each other, and forming a connection section with essentially at least two thicknesses of the sheet of metallic material facing one another; the contact portion has at least two cross sections of different values.

It is also disclosed a power connector comprising at least one terminal having at least one of the features listed above. This connector comprises a housing with at least one cavity accommodating the terminal, the terminal having a contact portion with—an external groove and an O-ring seal in the groove providing a sealing barrier between the terminal and the housing cavity, —an internal rib in sealing contact with the protection cap or the sealing element.

BRIEF DESCRIPTION OF THE DRAWINGS

Other features, objects and advantages of the invention will become apparent from reading the detailed description that follows, and the attached drawings, given as non-limiting examples and in which.

DETAILED DESCRIPTION

Figure 1:
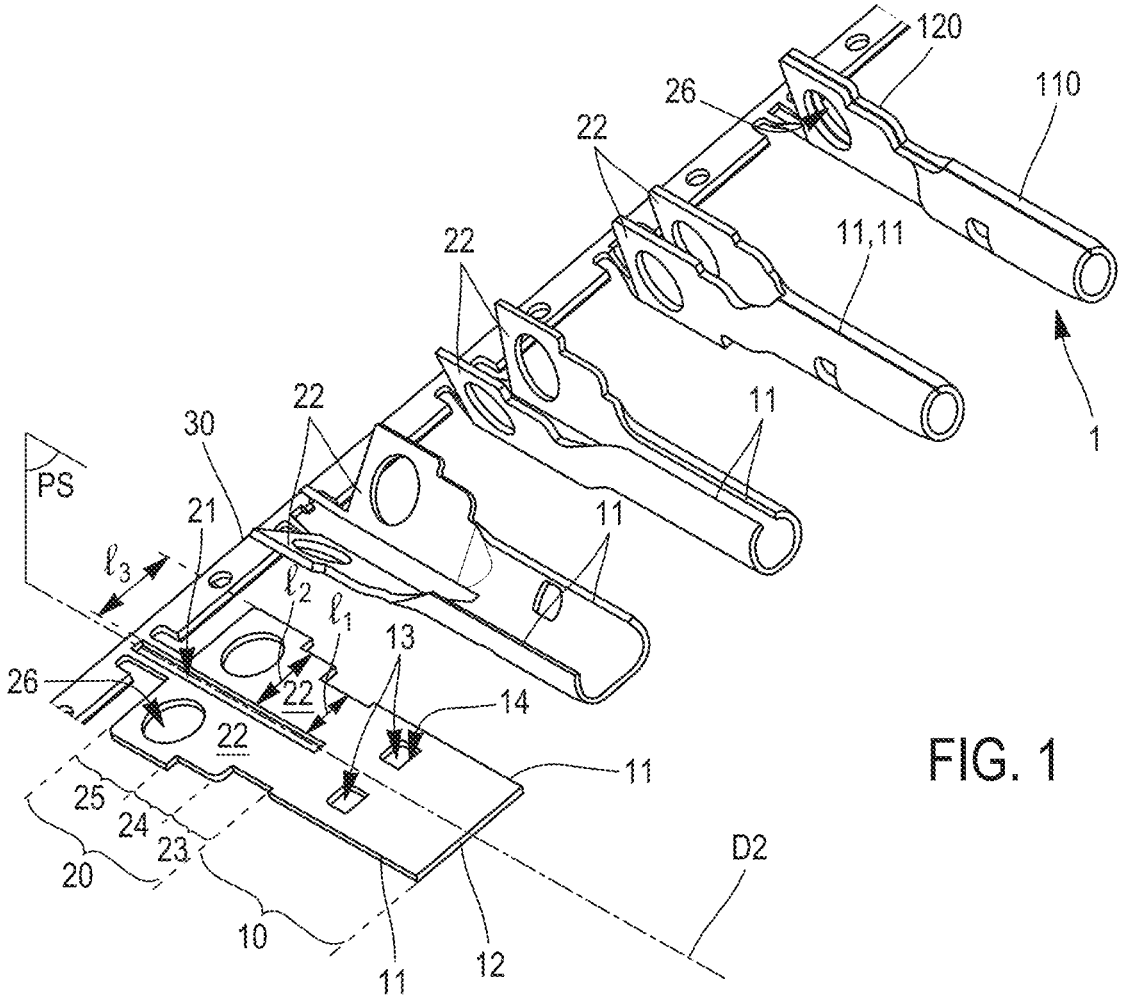
FIG. 1 schematically shows successive steps of an exemplary implementation of a method for manufacturing a male power terminal.

Examples of implementations of the method for manufacturing a male power terminal are described below. According to these examples, the method includes operations of cutting and forming a sheet metal, implemented for example on a multi-slide press. For example, a copper sheet 1.2 millimetres thick is used. This copper sheet is made for example of copper having a purity of 99% according to IACS standard (i.e. "International Annealed Copper Standard"). This sheet undergoes one or more cutting operations, at the end of which two regions 10, 20 are obtained. A first region 10 corresponds to the contact portion 110 of the male power terminal 1. A second region 20 corresponds to the connection portion of this terminal 1. The first 10 and second 20 regions are in continuity of material with each other. In other words, the first 10 and second 20 regions form a single-piece part. The second region 20 is connected to a carrier strip 30. After the stamping step, the first 10 and second 20 regions and the carrier strip 30 to which they are connected extend substantially in the same plane, corresponding to that of the copper sheet.

The first region 10 has an essentially rectangular shape, with two longitudinal edges 11 and a transverse edge 12 corresponding to the free end of the contact portion 110 (i.e. the free end of the first region 10). It comprises two cutouts 13 symmetrically disposed on either side of a plane of symmetry PS parallel to the longitudinal direction DL of the first region 10 and perpendicular to the longitudinal direction of the carrier strip 30. Each of these cutouts 13 has a straight edge 14, on its side located towards the free end of the first region 10, and perpendicular to the plane of symmetry PS. Alternatively, these cutouts are replaced by a notch embossed on the external surface of the contact portion (i. e. the surface opposed to the one seen on the planar blank on the left-hand side of FIG. 1).

The second region 20 has a slot 21 in the middle of which passes the plane of symmetry PS. This slot 21 separates two zones 22 symmetrically arranged with respect to the plane of symmetry PS. Each of these zones 22 comprises a first transition section 23, an intermediate section 24 and a connection section 25. The connection section 25 is wider than the intermediate section 24, which is itself wider than the transition section 23. For example, the connection section 25 has a width 13 of 20 millimetres, the intermediate section 24 has a width 12 of 15 millimetres and the transition section 23 has a width 11 of 10 millimetres. A round opening 26 is cut in the thickness of the sheet in the connection section 25. The connection section 25 is connected to the carrier strip by a small strip of sheet metal.

During at least one forming operation, the first region 10 begins to be rolled up by bringing its longitudinal edges 11 out of the plane of the sheet metal. During this operation, both zones 22 of the second region 20 are brought toward each other, in rotation about the longitudinal edges of the slot 21, and at the same time the longitudinal edges 11 are spaced apart from each other.

During at least one other forming operation, the first region 10 is further rolled up by bringing the longitudinal edges 11 towards each other. In addition, the angle between the two zones 22 of the second region 20 is a little more closed.

With at least another forming operation, the first region 10 is further rolled up so as to give it a tubular shape. The longitudinal edges 11 are brought against one another. The two zones 22 of the second region are now parallel to each other, but remain separated from one another.

With a subsequent forming operation, the two zones 22 of the second region 20 are brought together, aligning the openings 26 in coincidence one opposite the other.

Figure 2:
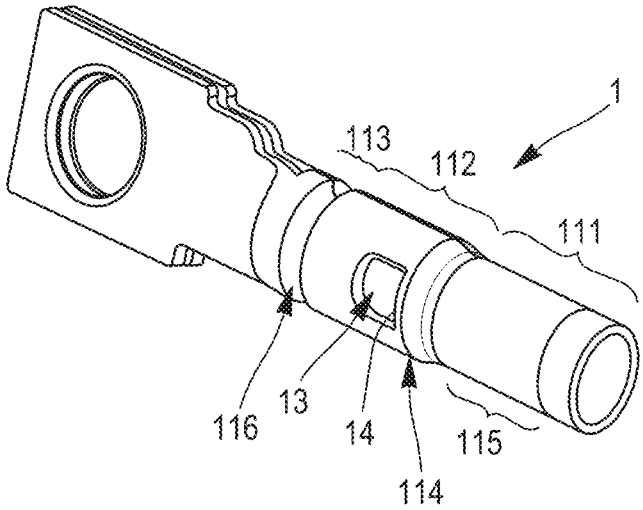
FIG. 2 is a schematic perspective view of the terminal body resulting from the manufacturing steps illustrated in FIG. 1.
Figure 3:
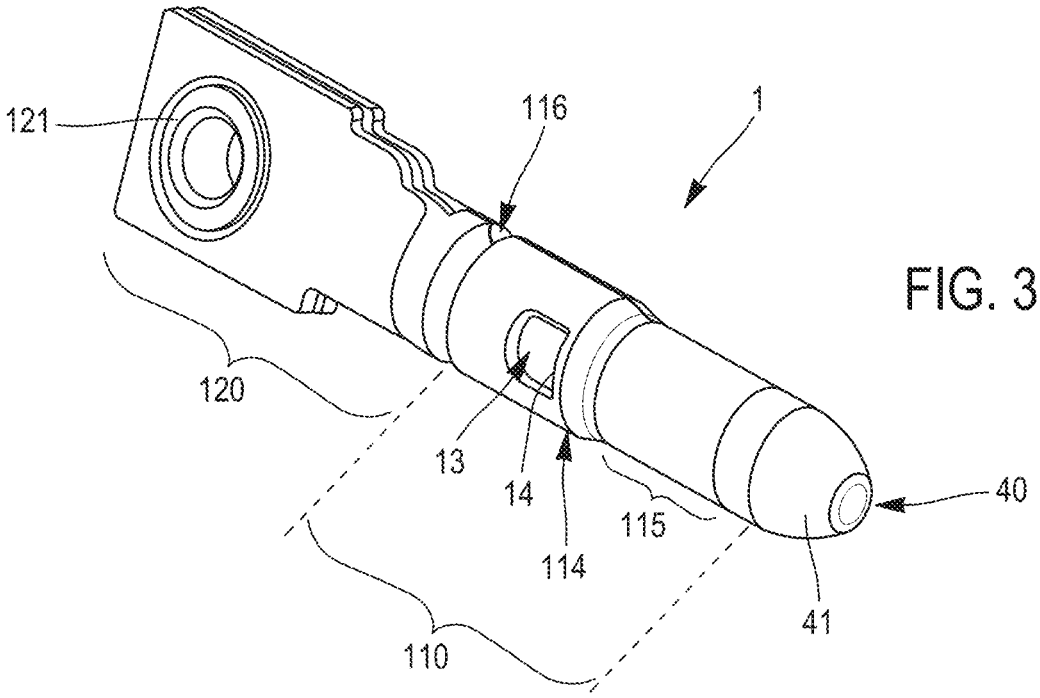
FIG. 3 is a schematic perspective view of the terminal body illustrated in FIG. 2 onto which a protection cap is mounted.

With another subsequent forming operation, the contact portion 110 is shaped in order to obtain, starting from the free end of the contact portion 110, a contact section 111, a locking section 112 and a sealing section 113 (see FIG. 2). The contact portion 110 (or pin) is a portion of the terminal 1 intended to make an electrical connection with a female terminal. The contact section 111 has a smaller diameter than the locking section 112. For example, the contact section 111 has a diameter of 8 millimetres and the locking section 112 has a diameter of 9 millimetres. Thus, the contact portion 110 includes a shoulder 114 between the contact section 111 and the locking section 112. The cutouts or notches 13 are diametrically opposite. Their straight edge 14 is located close to the shoulder 114 (see FIGS. 2 and 3).

The contact section 111 comprises a strip 115 of an electrodeposited metal making it possible to improve the quality of the electrical terminal between the male terminal 1 and a female terminal. For example, the metal is selectively electrodeposited on the metal sheet before the operations of cutting and forming described above This metal is for example a silver layer 3 to 5 micrometres thick.

Figure 4:
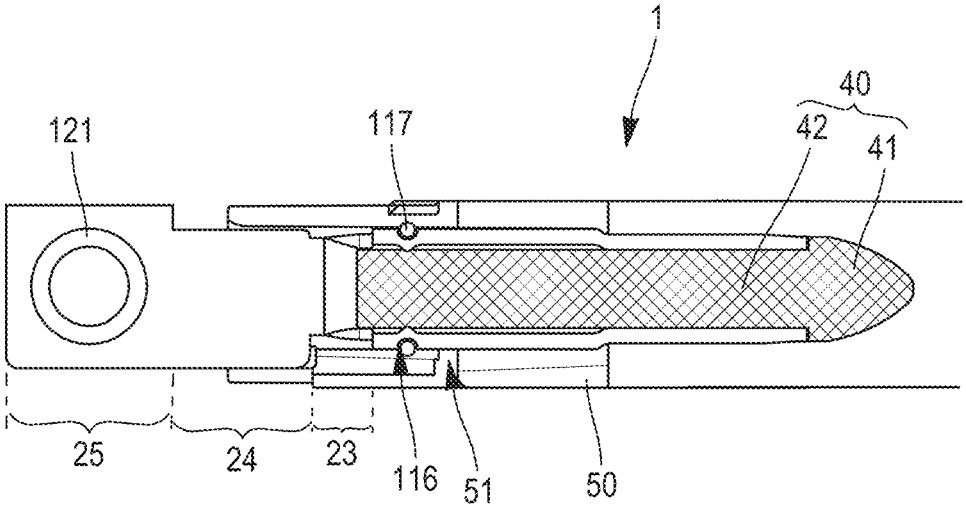
FIG. 4 is a schematic longitudinal cross-section of the terminal illustrated in FIG. 3 accommodated in a cavity of a power connector.

The sealing section 113 comprises a peripheral circular groove 116 for receiving an O-ring seal 117 (see also FIG. 4).

The second portion 20 comprises two thicknesses of metal sheet, arranged each essentially symmetrically with respect to each other, on either side of the plane of symmetry PS. The second portion 20 comprises a connection portion 120 which is a portion intended to connect the terminal 1 to an electrical power circuit. For example, the connection portion 120 connects the terminal 1 to a busbar (not shown).

Figure 5:
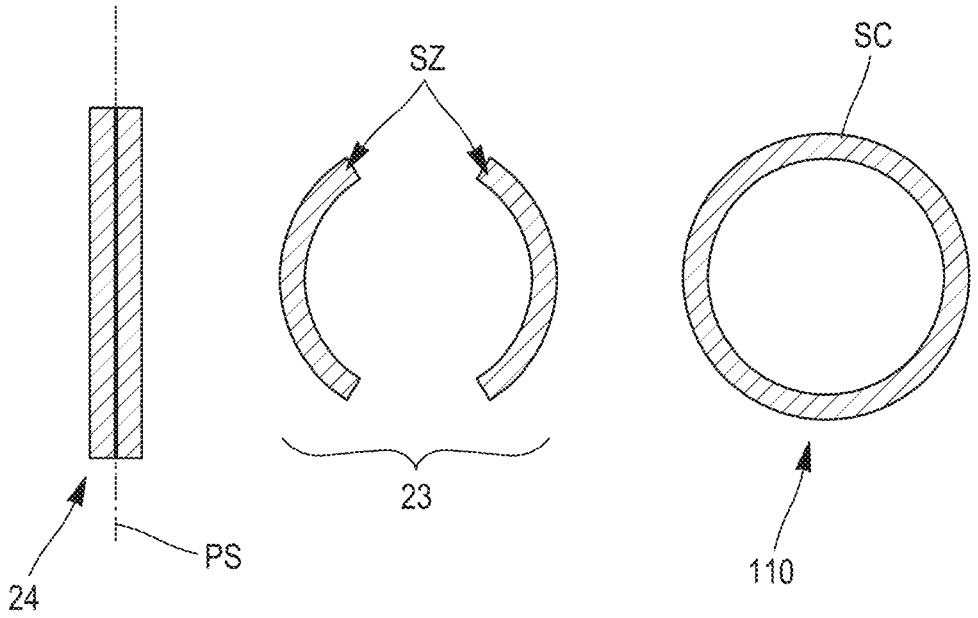
FIG. 5 schematically represents three transversal cross sections, respectively from left to right, at the level of the connection portion, at the level of the transition portion and at the level of the locking portion.

At the transition section 23, the sheet is curved in order to make the junction between the tubular shape of the contact portion 110 and the flat shape of the intermediate section 24. At the intermediate section 24 and the connection section 25, the terminal 1 comprises two thicknesses of metal sheet one over the other (see left hand-side cross section in FIG. 5) or alternatively facing each other with a gap in between. At the transition section 23, the two thicknesses of metal sheet are substantially vis-à-vis (see cross-section in the middle of FIG. 5). The cross section SZ of the terminal 1 is the smallest at the level of the transition section 23. At the transition section 23, the value of the cross section SZ of the terminal is for example of 15 mm2. It corresponds at least to 50%, and more preferably to 70%, of the value of the minimum cross section SC of the terminal at the level of the contact portion 110 (see right hand-side cross section in FIG. 5). Nevertheless, thanks to the two thicknesses of metal sheet, this cross section SZ is sufficient for transmitting a current, without excessive heating (less than or equal to 60° C.), up to at least 250 Amps. In other words, a connection portion 120 is formed having, generally, a double thickness. This ensures not too increase the constriction resistance.

A metal ring 121, for example a type of rivet M6, is inserted into the openings 26 formed in the connection section 25. This ring 121 is for instance intended for the fixation and the electrical connection of the terminal 1 on a conductive busbar (not shown).

According to the first example of implementation of the method for manufacturing a male power terminal illustrated by FIG. 4, a protection cap 40 made of an electrically insulating material is inserted in the contact portion 110, by the opening located on the free end side of the tubular region corresponding to the contact portion 110. This free end is at the opposite to of the connection portion 120. This protection cap 40 has a conical portion 41 and a cylindrical portion 42. The conical portion 41 extends beyond the free end of the contact portion 110 and thus gives the terminal 1 a protection according to the IP2X standard. The cylindrical portion 42 is introduced inside the tubular region formed by the contact portion 110. The cylindrical portion 42 extends up to the groove 116. Thus, the cylindrical portion 42 forms a first sealing barrier with the internal surface of the contact portion 110, between its free end and the cutouts 13, and a second sealing barrier, with the internal surface of the contact portion 110, at the groove 116, between the cutouts 13 and the connection portion 120.

When used in a connector 50, the terminal 1 is accommodated in a cavity 51. Two locking pawls 52 are made in one piece with the housing of the connector 50. When the terminal is in its operation position in the cavity 51, each locking pawl returns elastically in a cutout 13 (alternatively in a notch).

The O-ring seal 117 provides another sealing barrier between the external surface of the contact portion 110 and the wall of the cavity 51 in which the terminal 1 is accommodated. The cylindrical portion 42 of the protection cap 40 seals with the internal surface of the contact portion 110, at the level of a circular rib, corresponding to the groove 116. Thus, water cannot ingress in the connector 50, from the outside thereof, beyond this rib, even if it penetrates through the cutouts 13 or through the thin slot left between the longitudinal edges 11.

Figure 6:
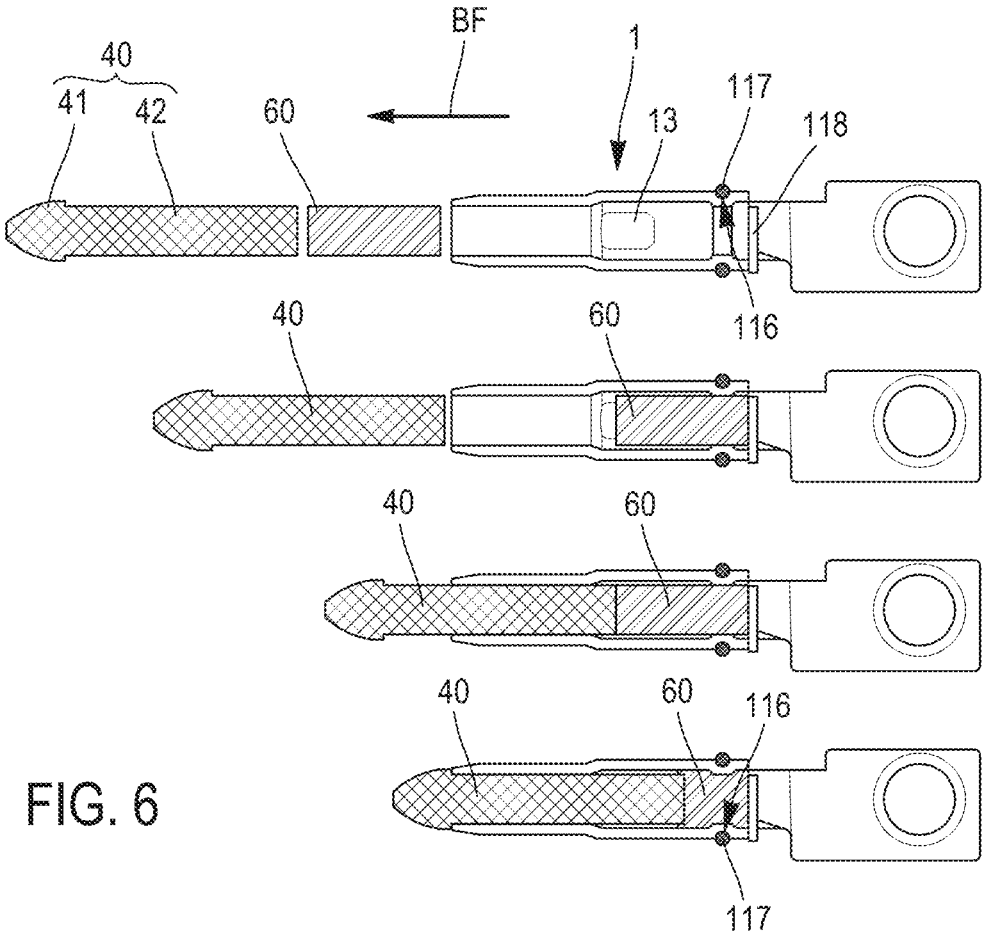
FIG. 6 schematically illustrates, with transversal cross sections, four successive steps of a method for manufacturing another embodiment of a male power terminal.
Figure 7:
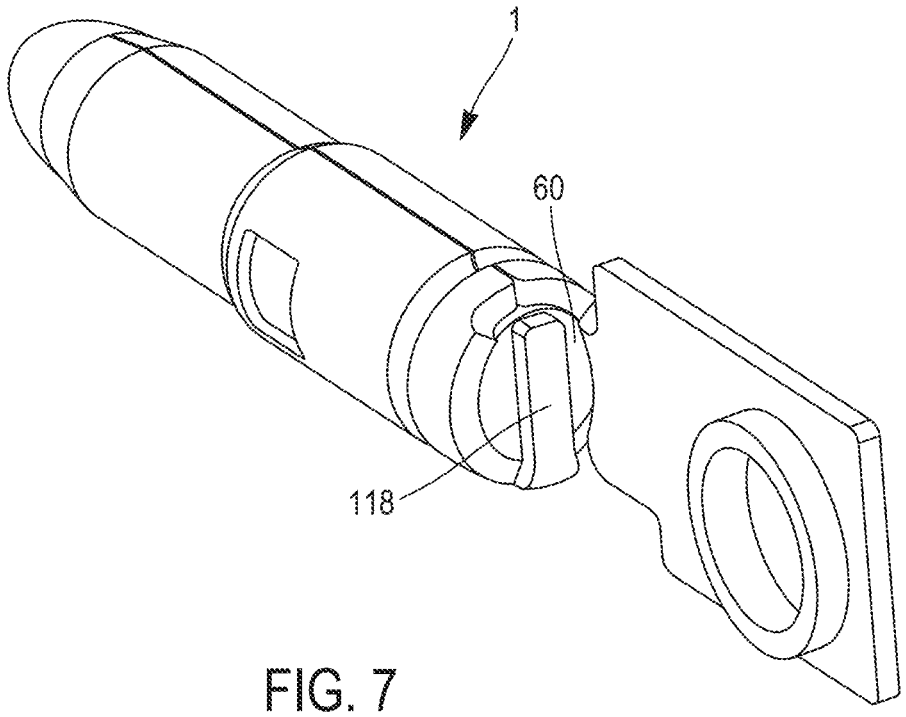
FIG. 7 is a schematic perspective view of the terminal resulting from the manufacturing steps illustrated in FIG. 6.
Figure 8:
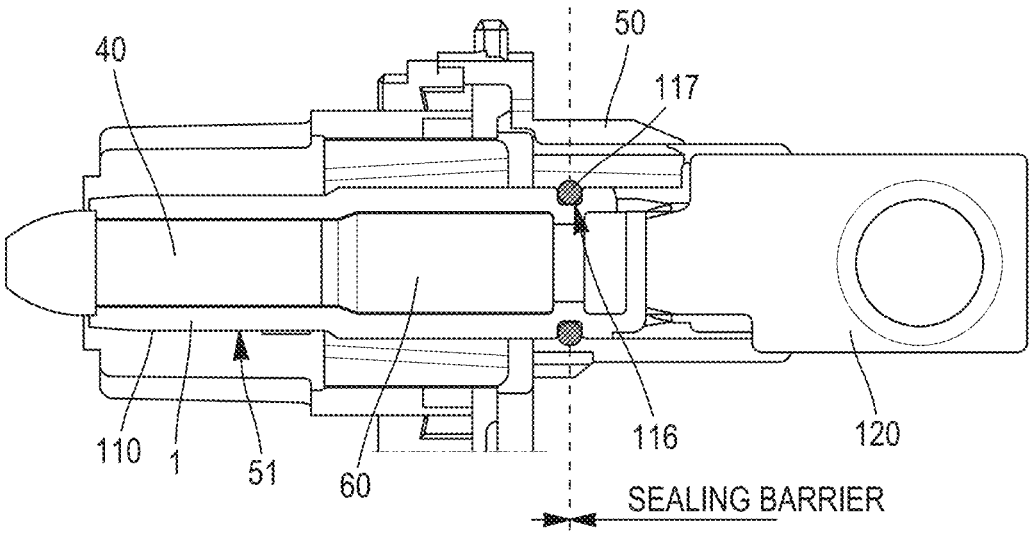
FIG. 8 is a schematic longitudinal cross-section of the terminal illustrated in FIG. 7 accommodated in a cavity of a power connector.

According to the second example of implementation of the method for manufacturing a male power terminal illustrated by FIGS. 6 to 8, both a sealing element 60 and a protection cap 40 are inserted in the contact portion 110. The protection cap 40 is similar to the one disclosed in connection with the previous example of method implementation. The protection cap 40 is made of an electrically insulating material. The protection cap 40 has cylindrical portion 42 than that of the protection cap disclosed in connection with the previous example of method implementation. The sealing element 60 has a generally cylindrical shape with a longitudinal dimension shorter than the length of the first region 10.

As shown in FIG. 6 (two first cross sections from the top of FIG. 6), the sealing element 60 is inserted first by the opening located on the free end side of the tubular region corresponding to the contact portion 110. Subsequently, as shown on the third and fourth cross sections of FIG. 6), the protection cap 40 is inserted by the opening located on the free end side of the tubular region corresponding to the contact portion 110. The protection cap 40 is pushed inside the tubular region so as to press the sealing element 60. As a consequence, the sealing element 60 is placed inside the tubular region, rear of the cylindrical portion 42 of the protection cap 40. The sealing element 60 provides a sealing barrier with the rib corresponding to the groove 116 wherein the O-ring seal 117 is positioned. In other words, the sealing element 60 provides a sealing barrier with the internal surface of the terminal 1 and the O-ring seal 117 provides a sealing barrier with the external surface of the terminal 1. Thus, water cannot ingress in the connector 50, from the outside thereof, beyond this sealing barriers, even if it penetrates through the thin slot left between the longitudinal edges 11.

The sealing element 60 is made of an elastomeric material and the protection cap 40 is made of a plastic material harder than the elastomeric material. Consequently, the plastic material of the protection cap 40 is chosen so as to be mechanically robust enough for not being damaged during the numerous mating cycles of the connector 50 with a counterpart connector. The elastomeric material is chosen so as to be soft enough for deforming and fitting closely and moulding the internal shape of the terminal 1. For example, the elastomeric material is a LR (Liquid Rubber) silicone with a 40+/−5 Shore A hardness, in a temperature ranging from −55° C. to +210° C. The sealing element 60 can be compressed by the protection cap 40, from 40 to 60%, for example.

Sealing tests were made (from both sides of the sealing barriers, i.e. positive and negative pressures), the results of which are summarized in the following table:

| Sealing test | Results |
|---|---|
| Positive pressure/1000 mbar during 30 s | Compliant* |
| Negative pressure/−500 mbar during 30 s | Compliant* |

*"compliant" means for example that no bubble appeared while sets comprising a connector and a mated connector are immersed during the tests or that no colored water is detected inside connectors immersed in water colored with fluorescein, after the tests.

The elastomeric material can be so soft that it flows behind the tubular region. It is however blocked by the two zones 22 of the second region 20 which are brought close, or in contact, to each other. In order to prevent the elastomeric material from flowing behind the tubular region, a stop portion 118 may be provided. Such stop portion 118 is for example integrally formed with the single-piece terminal. It is formed in bending a portion of the metal sheet at the rear side of the tubular region (See FIGS. 6 to 8).

What is claimed is:

1. A method for manufacturing a male power terminal, this terminal extending longitudinally in a back-to-front direction, from a connection portion to a contact portion, this method including a stamping step for cutting out a single-piece in a thickness of a sheet of metallic material, said single-piece having a first region corresponding to the contact portion and a second region corresponding to the connecting portion, the first and the second regions being in continuity of material with each other, and a forming step for bending the first region and forming a tubular region, the method including providing a protection cap made of dielectric material and having a first portion and a second portion, and inserting the first portion of the protection cap inside the tubular region characterized in that it further includes providing a sealing element having a generally cylindrical shape having a longitudinal dimension shorter than a length of the tubular region, the sealing element being made of an elastomeric material and the protection cap being made of a plastic material harder than said elastomeric material, and inserting the sealing element inside the tubular region, rear of the first portion of the protection cap, relatively to the back-to-front direction.

2. The method according to claim 1, comprising cutting out a stop portion during the stamping step, this stop portion being integrally formed with the single-piece, and comprising bending the stop portion at a rear side of the tubular region for preventing the sealing element from getting out of the tubular region when pushed back by the protection cap inserted in the tubular region.

3. The method according to claim 1, comprising forming an annular groove on an outer surface of the tubular region, this annular groove corresponding to an annular rib on an inner surface of the tubular region, and placing an O-ring seal in the groove and the sealing element in sealing contact with the rib.

4. The method according to claim 1, comprising bending two zones of the second region toward each other, to form a connection section with essentially at least two thicknesses of the sheet of metallic material facing one another.

5. The method according to claim 1, comprising at least one shaping operation resulting in the contact portion being shaped with at least two cross sections of different values.

6. A male power terminal extending longitudinally in a back-to-front direction, from a connection portion to a contact portion, the contact portion and the connection portion being formed from a single-piece of a sheet of metallic material, the contact portion having a cylindrical tubular region formed by the sheet of metallic material rolled up around a central axis, this male power terminal comprising a protection cap made of dielectric material and having a first portion and a second portion, the first portion of the protection cap being inserted inside the tubular region, and a sealing element having a generally cylindrical shape with a longitudinal dimension shorter than a length of the tubular region, this sealing element being inserted inside the tubular region, rear of the first portion of the protection cap, relatively to the back-to-front direction and the sealing element being made of an elastomeric material and the protection cap is made of a plastic material harder than said elastomeric material.

7. The terminal according to claim 6, comprising a stop portion integrally formed with the single-piece, the stop portion being bent at a rear side of the tubular region so as to prevent the sealing element from getting out of the tubular region at a rear side of the tubular region.

8. The terminal according to claim 6, having an annular groove on an outer surface of the tubular region, this annular groove corresponding to an annular rib on an inner surface of the tubular region, an O-ring seal being placed in the groove and the sealing element being in sealing contact with the rib.

9. The terminal according to claim 6, comprising two zones of the connection portion brought toward each other, and forming a connection section with essentially at least two thicknesses of the sheet of metallic material facing one another.

10. The terminal according to claim 6, wherein the contact portion has at least two cross sections of different values.

11. A power connector comprising at least one male power terminal extending longitudinally in a back-to-front direction, from a connection portion to a contact portion, the contact portion and the connection portion being formed from a single-piece of a sheet of metallic material, the contact portion having a cylindrical tubular region formed by the sheet of metallic material rolled up around a central axis, this male power terminal comprising a protection cap made of dielectric material and having a first portion and a second portion, the first portion of the protection cap being inserted inside the tubular region, and a sealing element having a generally cylindrical shape with a longitudinal dimension shorter than a length of the tubular region, this sealing element being inserted inside the tubular region, rear of the first portion of the protection cap, relatively to the back-to-front direction and the sealing element being made of an elastomeric material and the protection cap is made of a plastic material harder than said elastomeric material, the power connector comprising a housing with at least one cavity accommodating the at least one male power terminal, the at least one male power terminal having a contact portion with an external groove and an O-ring seal in the groove providing a sealing barrier between the at least one male power terminal and the at least one cavity of the housing, an internal rib in sealing contact with the protection cap or the sealing element.

* * * * *